US007703808B2

(12) United States Patent
Wilen

(10) Patent No.: US 7,703,808 B2
(45) Date of Patent: Apr. 27, 2010

(54) EXPANDABLE BUSINESS CARD

(76) Inventor: Richard Wilen, 2333 SW. 15th St., Deerfield Beach, FL (US) 33442

( * ) Notice: Subject to any disclaimer, the term of this patent is extended or adjusted under 35 U.S.C. 154(b) by 9 days.

(21) Appl. No.: 11/365,071

(22) Filed: Feb. 28, 2006

(65) Prior Publication Data

US 2007/0200336 A1 Aug. 30, 2007

(51) Int. Cl.
*B42D 5/00* (2006.01)

(52) U.S. Cl. ..... 281/15.1; 283/56; 281/3.1; 281/5; 229/67.3

(58) Field of Classification Search ..... 283/56, 283/61–62, 63.1, 34; 281/2, 5, 3.1, 15.1; 434/150–153; 150/131, 147, 148; 229/67.1, 229/67.3, 68.1, 70, 92.1, 92.8
See application file for complete search history.

(56) References Cited

U.S. PATENT DOCUMENTS

| | | | | | |
|---|---|---|---|---|---|
| 512,882 | A * | 1/1894 | Hillhouse | 283/34 |
| 542,872 | A * | 7/1895 | Craw | 283/56 |
| 780,867 | A * | 1/1905 | Davidson | 283/51 |
| 867,613 | A * | 10/1907 | Scragg | 229/92.8 |
| 930,290 | A * | 8/1909 | Hohn | 40/530 |
| 2,377,968 | A * | 6/1945 | Richman | 281/2 |
| 3,141,549 | A * | 7/1964 | Koehler | 206/232 |
| 4,216,979 | A * | 8/1980 | Janik | 283/58 |
| 4,441,270 | A * | 4/1984 | Crowell et al. | 40/534 |
| 5,015,137 | A * | 5/1991 | Stenner | 412/1 |
| 5,104,146 | A * | 4/1992 | Schulz et al. | 281/15.1 |
| 5,333,909 | A * | 8/1994 | Hedge, Jr. | 283/56 |
| 5,657,869 | A * | 8/1997 | Carroll, III | 206/451 |
| 5,725,252 | A * | 3/1998 | Crum et al. | 283/34 |
| 5,887,899 | A | 3/1999 | Dobbins | |
| 6,158,777 | A | 12/2000 | Twardosz | |
| 6,752,427 | B1 | 6/2004 | Wilen | 281/31 |
| 7,409,788 | B2 * | 8/2008 | Lauer et al. | 40/594 |
| 2002/0195816 | A1 | 12/2002 | Anise | |
| 2004/0113419 | A1 | 6/2004 | Silvestri | |

* cited by examiner

*Primary Examiner*—Dana Ross
*Assistant Examiner*—Pradeep C Battula
(74) *Attorney, Agent, or Firm*—James David Johnson

(57) ABSTRACT

An expandable business card is described that includes a first foldable page and a second foldable page. The first foldable page has a detachable business card. The second foldable page is connected to a booklet. The first page and second page are interconnected and slidingly engaged. When in a first folded position, the booklet is concealed within the perimeter of the expandable business card. When the expandable business card is opened in the second position, the booklet can expand to a predetermined size to provide an additional area for promotional information. The first page includes a projection that is not visible in the first folded position but then extends for viewing in the second open position.

20 Claims, 7 Drawing Sheets

EXPANDABLE BUSINESS CARD

FIELD OF THE INVENTION

The present invention relates to business cards and more specifically to business cards that can expand and provide additional surface area for the presentation of information.

BACKGROUND OF THE INVENTION

Foldable objects provide individuals with devices that can provide additional information compared to those that are simply two sided. Examples include booklets, such as U.S. Pat. No. 6,752,427 to Wilen, that defines a plurality of longitudinal panels that enclosed by an outer cover.

Business cards are a representation of an individual and yet provide only a limited amount of area for that representation. Many businesses, such as those related to art and advertising, are highly creative and desire to expand the amount of information that can be communicated by the traditional two sided business card formats.

A business card is needed that can expand and can provide a range of different kinds of information to the holder of the card.

SUMMARY OF THE INVENTION

The preferred embodiment of the present invention is an expandable business card that comprises a first page that includes a fold that joins two panels. A first panel includes a detachable portion. The second panel includes a projection. The first page has an inner side and an outer side. A second page has four sides and includes three panels joined by two folds. A slot is defined in one of the folds. The second page has an inner side and an outer side. The outer side of the second page is connected to the inner side of the first page. A booklet is attached to the inner side of the second page. The business card has a first closed position in which the first panel of the second page is a cover and the detachable portion is a business card. The third panel of the second page is an opposed cover. The projection is at least partially concealed. A second position of the expandable business card includes the covers opened to show the booklet and the projection.

The expandable business card wherein the second page has a first panel positioned under the first panel of the first page and the first panel of the second page includes a business card. The expandable business card in the second position includes the projection extending through the slot in the fold of the second page. The projection has two opposed sides and at least one of the sides of the projection can include at least one of text, an image and a graphic.

The booklet in the second position includes two viewable panels and is positioned inside the perimeter of a first panel and a second panel of the second page. The booklet can expand to a third position that includes four viewable panels. The booklet can expand to a fourth position that includes eight viewable panels. The expandable business card includes a second cover opposite the first cover that can function as a cover for the booklet.

In another embodiment, the expandable business card comprises a first page that includes a first panel detachable from a second panel along perforations. A fold joins the second panel and a third panel. The third panel projects from the second panel. The first page has an inner side and an outer side. A second page includes three panels joined by two folds. A slot is defined in one of the folds. The first page has an inner side and an outer side. The outer side of the second page is connected to the inner side of the first page. A booklet is connected to the inner side of the second page. A first position of the expandable business card includes the expandable business card in a closed position. The first panel of the second page is a cover that includes, for example, a detachable business card. The third panel of the second page is the opposed cover for the booklet. The projection and the booklet are at least partially concealed in the first closed position. A second position wherein the covers are opened to view the at least partially unfolded booklet. At least a portion of the third panel extends through the slot in the fold of the second page and is viewable. The booklet is positioned within the outer edges of the first panel and second panel of the second page. A third position wherein the booklet unfolds such that at least a portion of the booklet extends beyond the edges of the second page.

The expandable business card of claim wherein the booklet unfolds into a fourth position that is greater than the size of the second position. The expandable business card has a height of approximately 3.5 inches when viewed as booklet. The expandable business card has a width of approximately 2.9 inches when viewed as a booklet. The expandable business card of claim 9, wherein the expandable business card has a depth of approximately 0.1 inch.

BRIEF DESCRIPTION OF THE DRAWINGS

Preferred embodiments of the invention are described below with reference to the drawings, wherein like numerals are used to refer to the same or similar elements.

DETAILED DESCRIPTION

Figure 1:
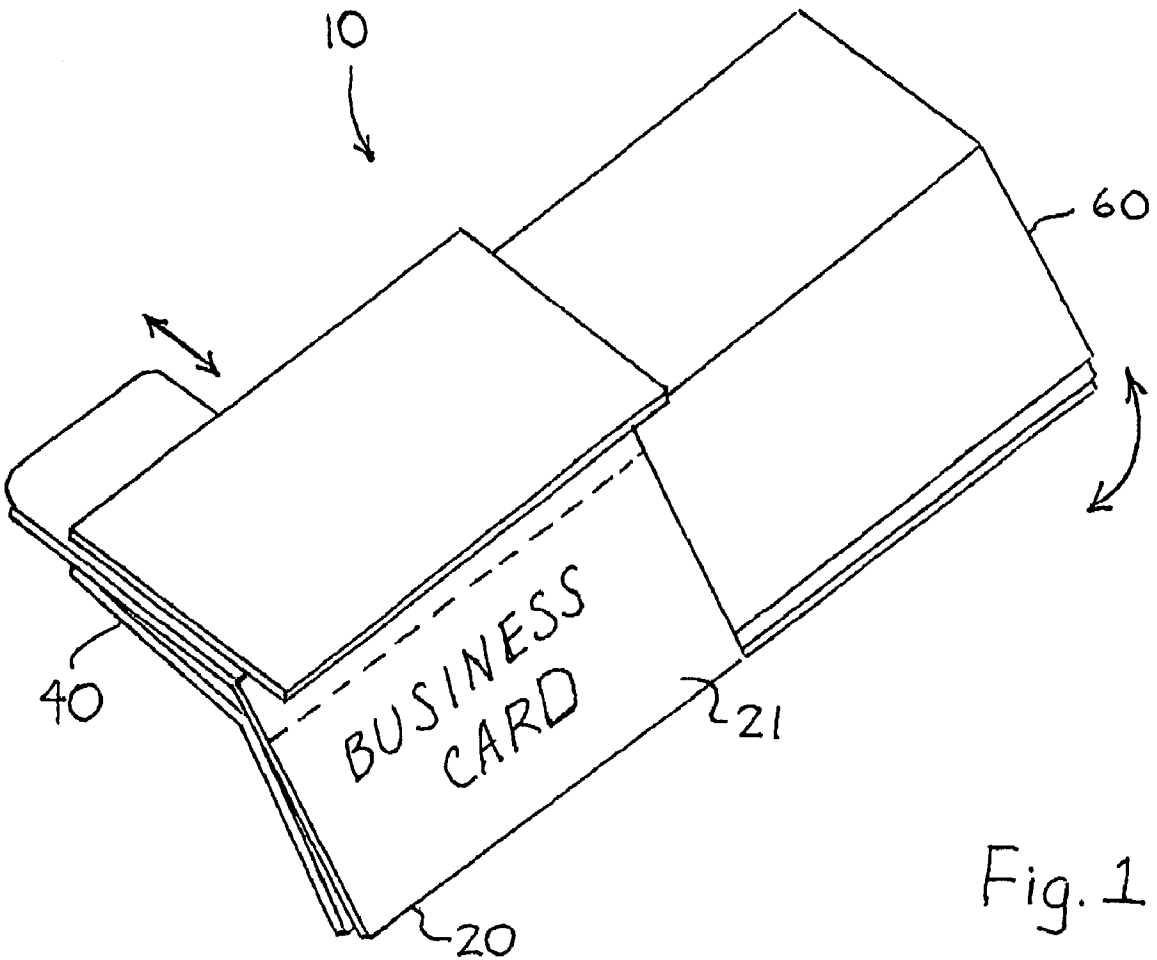
FIG. 1 is a top frontal perspective view of an expandable business card of the present disclosure.

Referring to FIG. 1, the preferred embodiment of an expandable business card 10 includes a first page 20, a second page 40 and a booklet 60. First page 20 and second page 40 are connected and interrelated. Booklet 60 is connected to second page 40. Expandable business card 10 can advantageously expand to provide additional surface areas for the positioning of images, graphics and/or trademarks associated with the cardholder and/or the cardholder's business.

Figure 2:
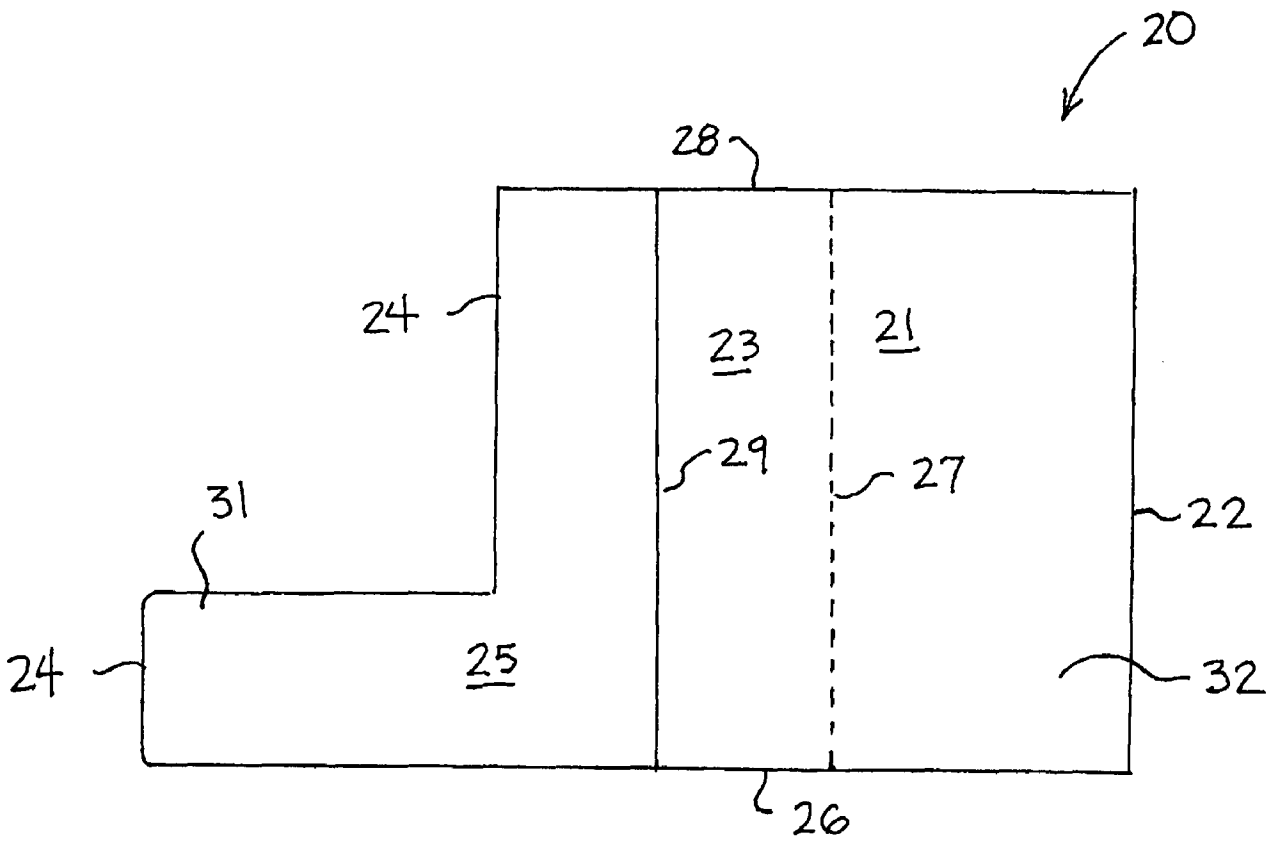
FIG. 2 is a plan view of a first page of the expandable business card of FIG. 1.

As shown in FIG. 2, first page 20 has a first edge 22 opposed by a second edge 24 and a third edge 26 opposed by a fourth edge 28. First page 20 includes a first panel 21, a second panel 23 and a third panel 25. First panel 21 and second panel 23 are preferably separated by perforations 27. First panel 21 is preferably a business card that can be readily separated from second panel 23 by tearing along perforations 23. The bottom of the business card includes edge 22 and the sides include a portion of opposed edges 26 and 28.

Third panel 25 is connected to second panel 23 by a fold 29. The second panel includes a projection 31. The terminal end of projection 31 includes an outer portion of second edge 24 that forms a corner with edge 26. Second edge 24 has an inner portion that forms a corner with edge 28 and is connected to projection 31. In this preferred embodiment first edge 22, second edge 24, perforations 23 and fold 29 are approximately parallel. First page 20 has a first side 32 opposed by a second side 34 (See FIG. 4).

Figure 3:
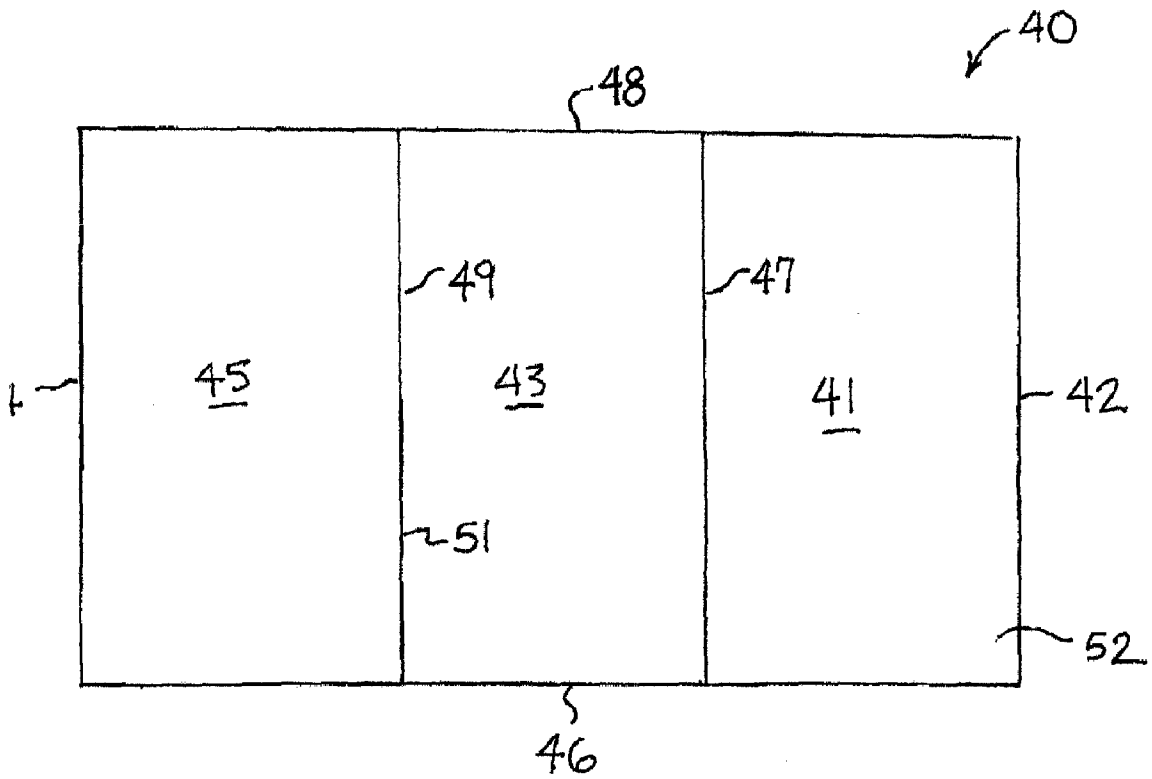
FIG. 3 is a plan view of a second page of the expandable business card of FIG. 1.

Referring now to FIG. 3, second page 40 includes a first edge 42 opposed by a second edge 44 and a third edge 46 opposed by a fourth edge 48. Second page 40 has a first panel 41, a second panel 43 and a third panel 45. A first fold 47 separates the first panel 41 and the second panel 43. A second fold 49 separates the second panel 43 and third panel 45. First panel 41 can include a detachable or non-detachable business card.

In the preferred embodiment, first fold 47 includes a slot 51. Slot 51 can be a cut along a portion of fold 47 that preferably runs a predetermined distance in an inward direction from edge 46 or a hole in portions of panels 43 and/or 45. As required, fold 47 can also include reinforcing to ensure the long term integrity of the connection of panels 41 and 43. Second page 40 also includes an outer side 52 and an inner side 54 (See FIG. 4).

In the preferred embodiment, edges 26 and 28 and 46 and 48 are approximately parallel and have a fixed dimensional distance between the respective edges such that edges 26 and 46 and 28 and 48 can be aligned. Similarly, edges 22 and 42 and edges 24 and 44 are parallel. Edges 22 and 42 and edges 24 and 44 can each be aligned to form a single combined edge.

Figure 4:
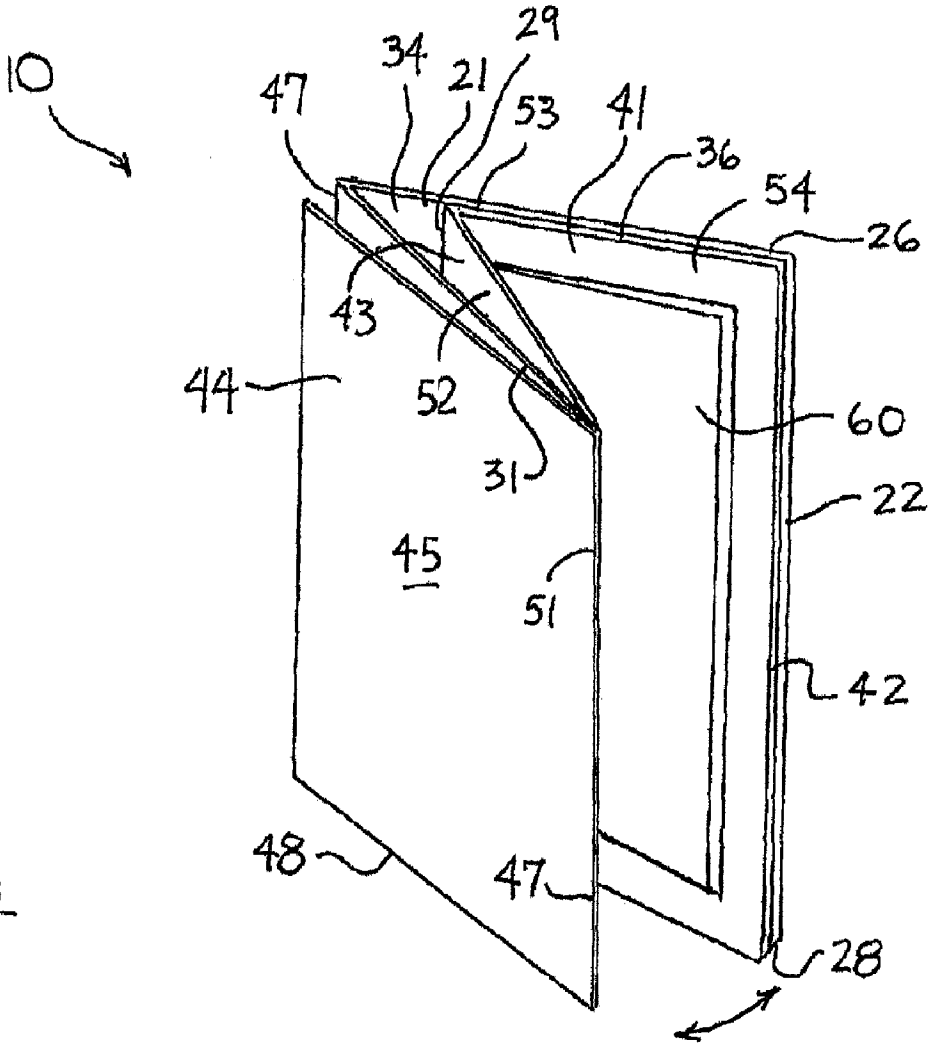
FIG. 4 is a top rear perspective view of a first page of the expandable business card of FIG. 1.

As shown in FIG. 4, expandable business card 10 is in a position in a partially open position in which booklet 60 is folded and/or unexpanded within the perimeter of pages 20 and 40. Business card 10 has a first unexpanded position in which fold 47 and edges 42 and 22 are in close proximity and edge 44 is in apposition with fold 47. Card 10, as show has edges 28 and 48 directed downward such that card 10 is positioned like a miniature book. Portions of second sides 34 and 44 of first page 20 and second page 40 are viewable in this position. Projection 51 is partially hidden from view between first side 52 of panels 43 and 45.

Expandable business card 10 in this one preferred embodiment has dimensions that are approximately 3.5 inches in height, approximately 2.875 inches in width and approximately 0.125 inches in depth when fully folded and unexpanded. It is understood that the external dimensions of expandable business card 10 can vary depending upon the desired application, but is intended to be sized such that it can easily carried in a wallet, purse or pocket. Expandable business card 10 is preferably made of paper or paper based products, but can also include plastics or composite materials. The folds of page 20, page 40 and booklet 60 can be preformed flexible hinges or include a separate connecting hinge.

First side 52 and second side 34 preferably have a connection 53 made by an adhesive that extends in a line or strip approximately between edges 26, 36 and edges 28, 48. Connection 53 is preferably approximately parallel to and positioned in proximity to fold 47. Connection 53 places fold 47 and fold 29 at a predetermined fixed distance that functions to slidingly engage pages 20 and 40 to retract projection 31 in the folded or closed position and extend projection 31 in any of the expanded positions. Alternative methods for connecting include common fasteners such as staples, as well as heat bonding. Booklet 60 is attached to second side 44 of panels 41 and 43.

Figure 5:
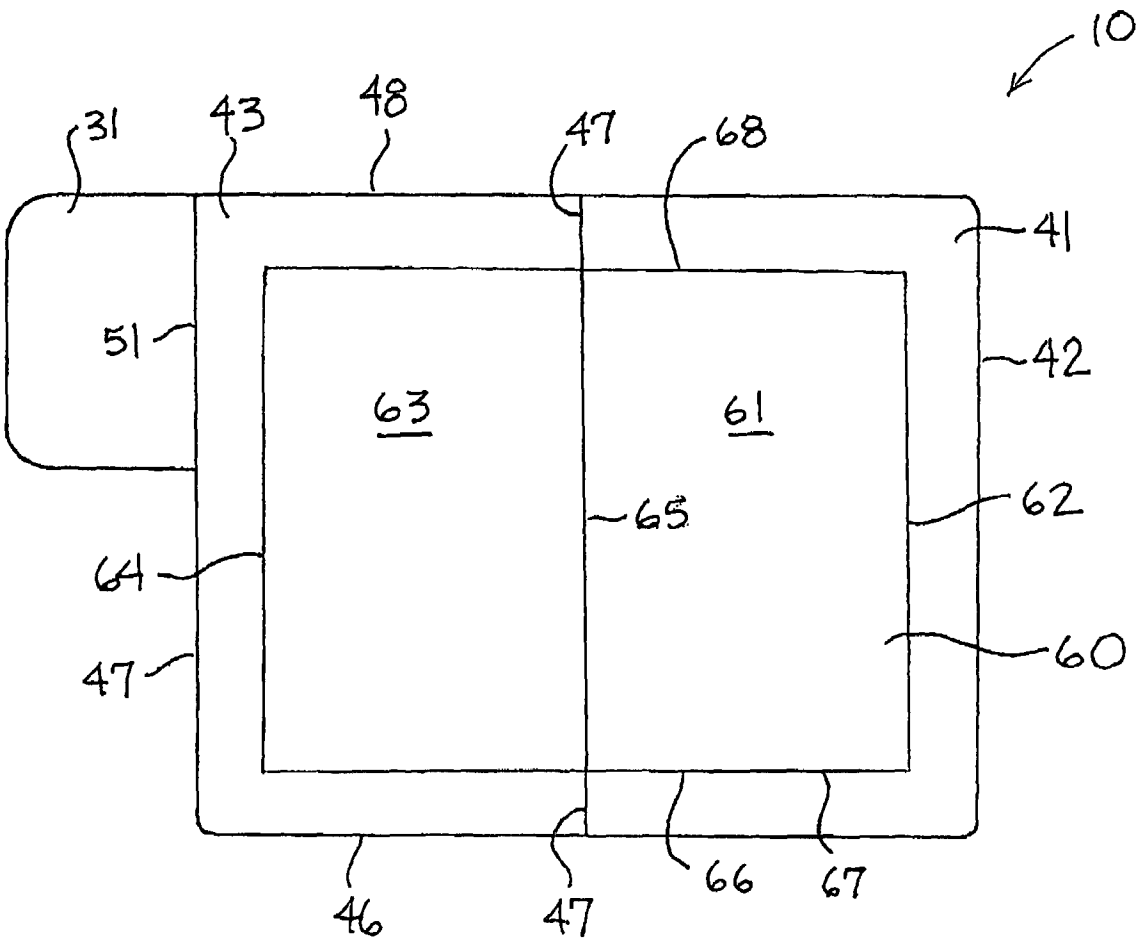
FIG. 5 is a plan view of the opened expandable business card of FIG. 1 in a first expanded position showing a booklet.

In operation, referring now to FIGS. 4 and 5, as expandable business card 10 is unfolded or expanded about fold 47 the fixed relationship of pages 20 and 40 and position of fold 29 relative to fold 47 and connection 53 extends projection 31 through slot 51. In this position at least a portion panel 45 and edge 44 extends over panel 41. As card 10 is moved into a first expanded position, panel 41, panel 43, booklet 60 and projection 31 are shown. Business card 10 unfolds or expands about connection 53 and fold 47.

Referring now to FIG. 5, booklet 60 in the first expanded position includes a first side 62, an opposed second side 64, a third side 66 and an opposed fourth side 68. Booklet 60 in this position has two panels 61 and 63. A first fold 65 separates panels 61 and 63 and is aligned with fold 47. Side 64 includes a third fold 69. The opening of expandable business card 10 extends projection 31 through slot 51 and provides an eye catching additional viewable surface for an advertisement; image and/or trademark. The folded dimensions of booklet 60 in the first expanded position are less than that of edges 42, fold 47, edge 46 and edge 48 of second page 40.

Figure 6:
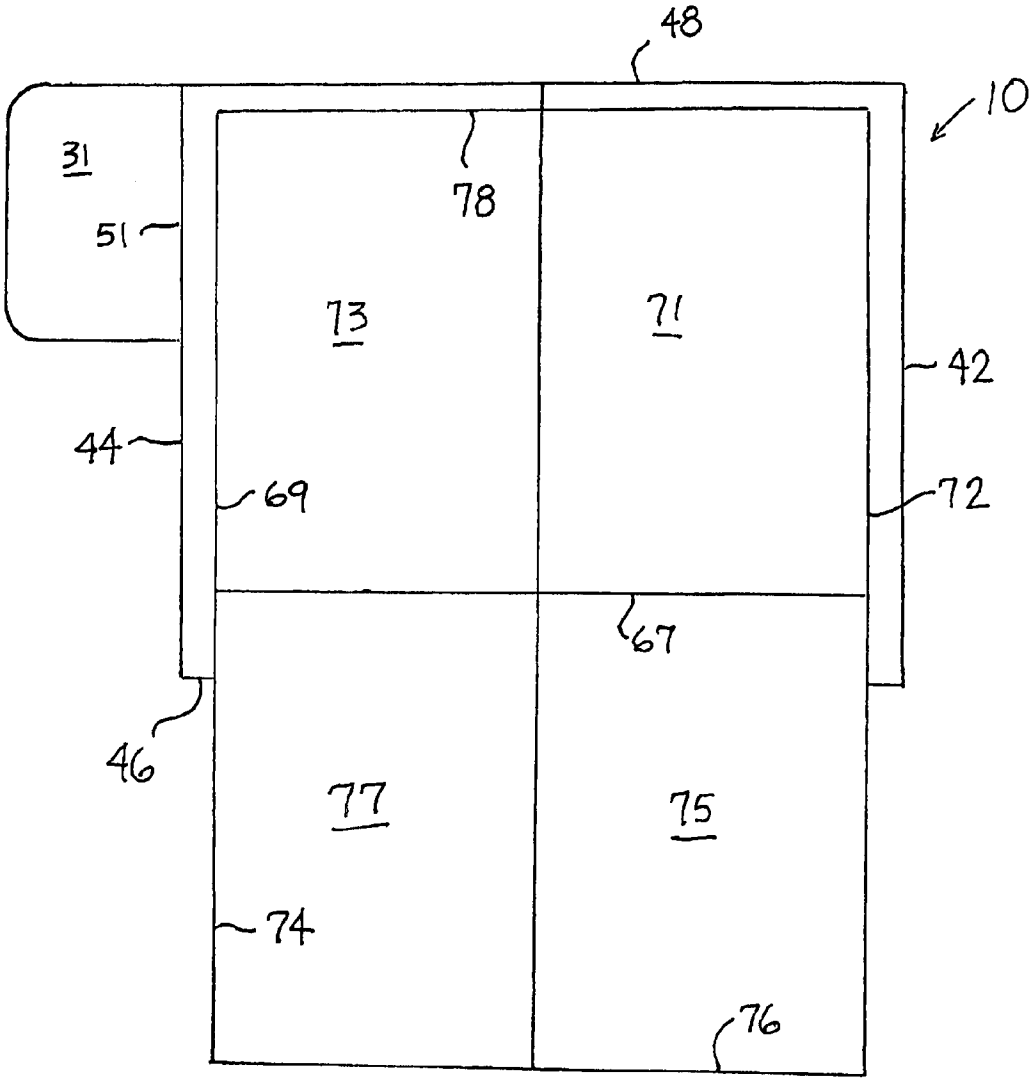
FIG. 6 is a plan view of the booklet of the expandable card of FIG. 5, in a second expanded position.

As shown in FIGS. 5 and 6, booklet 60 has unfolded and/or expanded into a second expanded position that includes unfolding along a fold 67 to show a first page of booklet 60 that has panels 71, 73, 75 and 77. The booklet 60 may contain up to thirty-two pages depending on the weight and thickness of the paper used. Booklet 60 in this second expanded position includes a first side 72, an opposed second side 74, a third side 76 and an opposed fourth side 78. Second fold 67 is preferably approximately parallel to edges 46 and 48 and can be either in proximity to edge 46 or edge 48. Panels 75 and 77 in this preferred embodiment extend beyond edge 46, but the remainder of booklet 60 preferably remains inside of edges 42, 44 and 48. Booklet 60 can also include a third fold 69 on side 64 that is now fully extended. This position provides a further expansion of surface area for text, images and advertising.

Figure 7:
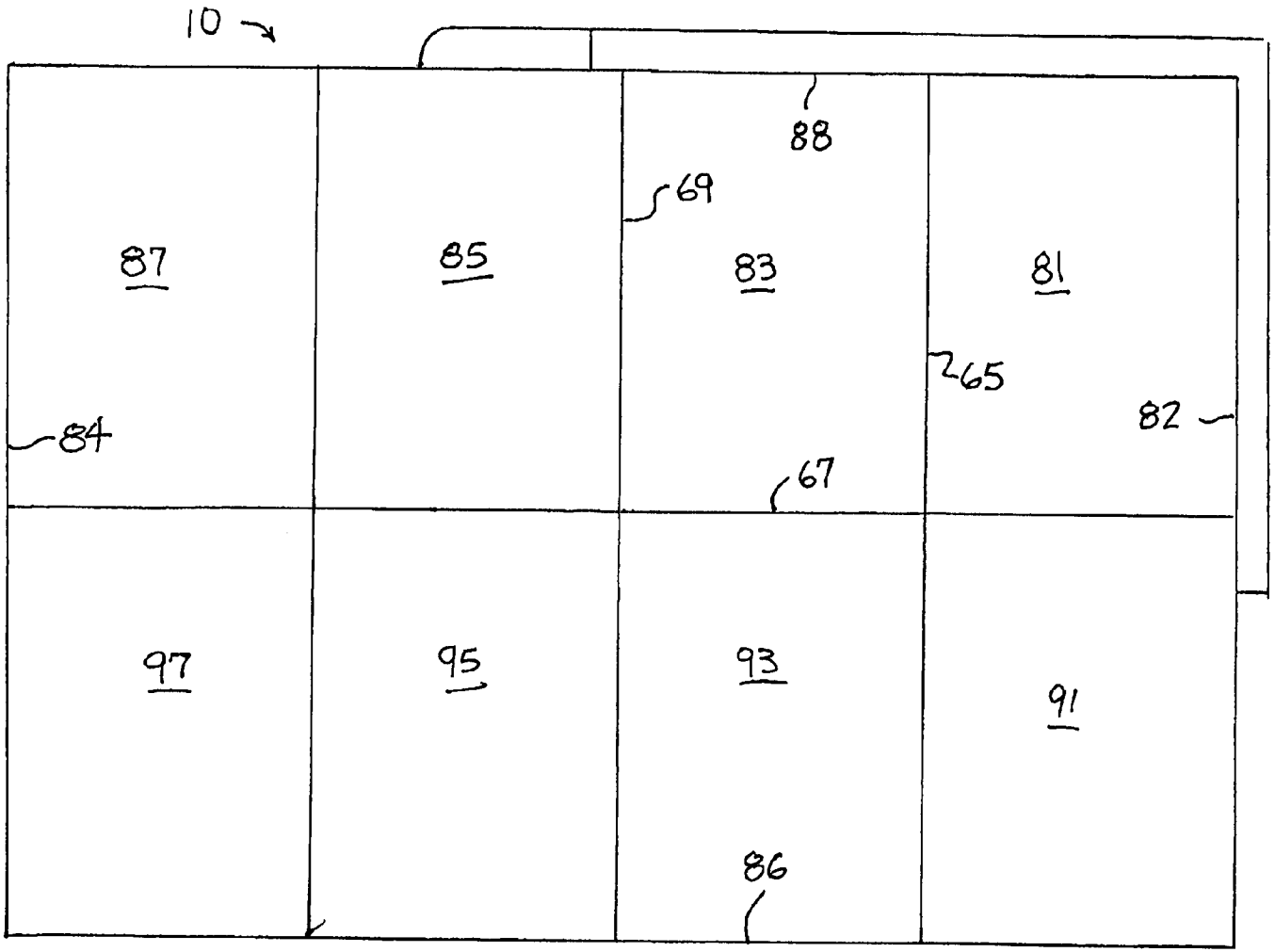
FIG. 7 is a plan view of the booklet of the expandable card of FIG. 5, in a third expanded position.

Referring now to FIGS. 6 and 7, booklet 60 has unfolded and/or expanded into a third expanded position that includes unfolding along fold 69 to show a third page of booklet 60 that has panels 81, 83, 85, 87, 91, 93, 95 and 97. Booklet 60 in this third expanded position includes a first side 82, an opposed second side 84, a third side 86 and an opposed fourth side 88. Booklet 60 can have a single page or multiple pages (up to thirty-two pages depending on the weight and thickness of the paper) each having one or more panels. In this third expanded position, booklet 60 extends beyond edges 44 and 46, but preferably remaining inside of edges 42 and 48.

Expandable business card 10 is returned to the first unfolded position by folding booklet 60 about folds 69 and 67. Booklet 60 is then conveniently stored within the outer covers of expandable business card 10 and reduced to a convenient carrying size.

It is understood that while booklet 60 is described as having three positions for unfolding, booklet 60 can expand in a range from only the first expanded position to a plurality of expanded positions depending upon the desired application. Similarly, booklet 60 can include different quantities of folds that unfold or expand in differing directions that are also considered variations within the scope of the present disclosure.

In the preceding specification, the invention has been described with reference to specific exemplary embodiments thereof. It will however, be evident that various modifications, combinations and changes may be made thereto without departing from the broader spirit and scope of the invention as set forth in the claims that follow. For example, the external shape of expandable business card 10 can vary to provide a range of eye catching shapes and still retain the present functions. The specification and drawings are accordingly to be regarded in an illustrative manner rather than a restrictive sense.

What is claimed is:

1. An expandable business card that comprises:

a first page comprising that includes a first panel detachable from a second panel along perforations and a fold that joins the second panel and a third panel, wherein the third panel comprises a projection projects from the second panel, and wherein the first page further comprises an inner side and an outer side;

a second page comprising a first panel, a second panel and a third panel that are that includes three panels joined by two folds, wherein one of the two folds comprises a slot defined in one of the folds, wherein the first page and the second page are attached by a connection that is in proximity with the fold that includes the slot, wherein the connection places the folds at a predetermined distance to enable extension or retraction of extend or retract the projection through the slot, wherein the second page comprises an inner side and an outer side, and wherein the outer side of the second page is connected to the inner side of the first page; and a booklet connected to the inner side of the second page;

wherein whereby the expandable business card further comprises: (a) includes a first position wherein the expandable business card is closed and the first panel of the second page comprises a cover that comprises includes a detachable business card and the third panel of the second page comprises an is the opposed cover for the booklet so that the projection and the booklet are at least partially concealed when the expandable business card is configured in the first position, and wherein the booklet is positioned between the first panel and second panel of the second page, (b) a second position wherein the covers are capable of being opened to view the at least partially unfolded booklet, wherein the booklet is capable of being unfolded, wherein the projection extends at least a portion of the third panel of the first page extended through the slot in the fold of the second page and is viewable when the expandable business card is configured in the second position, the booklet positioned within the outer edges of the first panel and second panel of the second page, and (c) a third position wherein the booklet is unfolded unfolds such that at least a portion of the booklet extends beyond the edges of the second page.

2. An expandable business card apparatus that comprises:

a first page comprising an inner side and an outer side and further comprising:

(i) a first panel comprising a detachable portion;

(ii) a second panel detachably joined by perforations to the first panel; and (iii) a third panel comprising a projection and joined by a first fold to the second panel;

a second page comprising an inner side and an outer side and further comprising:

a first panel joined by a second fold to a second panel and the second panel joined by a third fold to a third panel, wherein the third fold comprises a slot, wherein the inner side of the first page and the outer side of the second page are attached by a connection that retains the first fold and the second fold at a predetermined distance to enable the extension and retraction of the projection through the slot; and a booklet attached to the inner side of the second page.

3. The business card apparatus of claim 2, wherein the business card apparatus comprises a closed position and an open position.

4. The business card apparatus of claim 3, wherein in the closed position, the third panel of the second page comprises a cover and the first panel of the first page is an opposed cover.

5. The business card apparatus of claim 4, wherein the second page comprises a detachable business card that is formed by a panel selected from the group consisting of the first panel and the third panel of the second page.

6. The business card apparatus of claim 3, wherein the projection is retracted into the slot and is at least partially concealed when the business card apparatus is configured in the closed position.

7. The business card apparatus of claim 3, wherein the projection is extended out of the slot and the booklet is revealed when the business card apparatus is configured in the open position.

8. The business card apparatus of claim 3, wherein the booklet is attached between the first panel and the second panel of the second page and wherein, when the business card apparatus is configured in the open position, the booklet is capable of being opened to expose two viewable panels.

9. The business card apparatus of claim 8, wherein the booklet comprises a folded sheet capable of being unfolded into an unfolded position that is greater in size than the two viewable panels.

10. The business card apparatus of claim 2, wherein the first panel of the first page and the first panel of the second page are attached by the connection.

11. The business card apparatus of claim 2, wherein the projection comprises two sides and at least one of the sides of the projection comprises at least one item selected from the group consisting of text, an image and a graphic.

12. The business card apparatus of claim 2, wherein the booklet comprises a folded sheet that is attached between the first and second panels of the second page, and wherein the booklet can be unfolded to expose more than two viewable panels.

13. The business card apparatus of claim 2, wherein the business card apparatus is sized to be capable of being carried in a wallet, purse or pocket.

14. A business card comprising:

a first trifold sheet comprising three panels, wherein one of the three panels comprises a projection;

a second trifold sheet comprising three panels and attached to the first trifold sheet by a connection, wherein two of the three panels comprises a slot defined between the two panels; and a booklet attached to an inner side of the second trifold sheet;

wherein the business card comprises an open configuration and a closed configuration, wherein the projection is retracted when the business card is oriented in the closed configuration and is extended when the business card is oriented in the open configuration.

15. The business card of claim 14, wherein the booklet and projection comprise indicia selected from the group consisting of: text, graphics, and images, which are revealed when the business card is manipulated into the open configuration.

16. The business card of claim 14, wherein the three panels of the first trifold sheet comprise a first panel, a second panel and a third panel and wherein the three panels of the second trifold sheet comprise a first panel, a second panel and a third panel.

17. The business card of claim 16, wherein the first panel and second panel of the first trifold sheet are separated by a first fold, wherein the second panel and third panel of the first trifold sheet are separated by a second fold, wherein the first panel and second panel of the second trifold sheet are separated by a third fold, and wherein the second panel and third panel of the second trifold sheet are separated by a fourth fold.

18. The business card of claim 17, wherein the first panel of the first trifold sheet and first panel of the second trifold sheet are aligned and attached by the connection on and around where the third fold contacts the first panel of the first trifold sheet.

19. The business card of claim 17, wherein the third panel and the projection of the first trifold sheet are slidably disposed between second panel and the panel of the second trifold sheet, wherein the second panel and the panel of the second trifold sheet are rotatable at the connection and fourth fold so that the business card can be positioned in the open configuration or closed configuration, and wherein as the second panel and the panel of the second trifold sheet are rotated to position the business card in the open configuration, the third panel of the first trifold sheet, the projection and the second fold are slidably movable toward the slot defined between the second panel and the panel of the second trifold sheet so that the projection extends out of the slot between the second panel and the panel of the second trifold sheet when the business card is positioned in the opened configuration.

20. The business card of claim 16, wherein the first panel and the second panel of the first trifold sheet comprise a single unfolded panel separated by perforations.

* * * * *